US007690389B2

(12) United States Patent
Barreiro

(10) Patent No.: US 7,690,389 B2
(45) Date of Patent: Apr. 6, 2010

(54) WHEELCHAIR UMBRELLA AND ASSOCIATED METHOD

(76) Inventor: Katherine Barreiro, 505 La Guardia Pl., Apartment 19 F, New York, NY (US) 10012

( * ) Notice: Subject to any disclaimer, the term of this patent is extended or adjusted under 35 U.S.C. 154(b) by 132 days.

(21) Appl. No.: 11/827,930

(22) Filed: Jul. 16, 2007

(65) Prior Publication Data

US 2008/0023052 A1 Jan. 31, 2008

Related U.S. Application Data

(60) Provisional application No. 60/820,872, filed on Jul. 31, 2006.

(51) Int. Cl.
*E04H 15/06* (2006.01)

(52) U.S. Cl. ..... 135/88.01; 135/16

(58) Field of Classification Search ..... 135/16, 135/88.01, 88.02, 88.03; 280/304.1; 297/184.1, 297/184.15, 184.16
See application file for complete search history.

(56) References Cited

U.S. PATENT DOCUMENTS 554,792 A * 2/1896 Pittenger et al. ..... 135/88.01
670,268 A * 3/1901 Braun ..... 296/111
3,407,825 A * 10/1968 Doyle ..... 135/98
4,506,688 A * 3/1985 Bethoon et al. ..... 135/140
4,609,175 A 9/1986 Conover
4,809,724 A * 3/1989 Fuser ..... 135/16
5,168,889 A 12/1992 Diestel
5,286,134 A * 2/1994 Huang ..... 403/389
5,301,975 A 4/1994 Rivera
5,921,258 A 7/1999 Francois
6,789,557 B1 * 9/2004 Wahl, Jr. ..... 135/154
6,899,388 B1 * 5/2005 Enrique ..... 297/184.16
2002/0024229 A1 * 2/2002 Davies et al. ..... 296/77.1
2002/0157693 A1 * 10/2002 Whitmer ..... 135/16
2004/0103934 A1 * 6/2004 Szumlic et al. ..... 135/16
2004/0222678 A1 * 11/2004 Hansen ..... 297/184.1
2008/0018146 A1 * 1/2008 Wahl ..... 297/184.15

* cited by examiner

*Primary Examiner*—David Dunn
*Assistant Examiner*—Noah Chandler Hawk

(57) ABSTRACT

The wheelchair umbrella includes an umbrella section with a circular canopy. Such a canopy has a center region statically attached to the top ends of the arms. The apparatus further includes a pair of coextensively shaped rectilinear arms with top ends directly connected to the umbrella section, a mechanism for removably attaching bottom ends of the arms to associated ones of the handles of the existing wheelchair, a mechanism for storing and transporting the wheelchair umbrella during non-operating conditions, and a mechanism for securing the storage and transport mechanism to the existing wheelchair during operating conditions.

6 Claims, 9 Drawing Sheets

WHEELCHAIR UMBRELLA AND ASSOCIATED METHOD

CROSS REFERENCE TO RELATED APPLICATIONS

This application claims the benefit of U.S. Provisional Application No. 60/820,872, filed Jul. 31, 2006, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to umbrellas and, more particularly, to a wheelchair umbrella for providing a barrier between a user and the sun and rain thereby allowing the user to comfortably employ an existing wheelchair in outdoor environments.

2. Prior Art

Individuals who use manual wheelchairs generally have lower extremity weakness, paralysis, or amputation, which makes walking unsafe or difficult at best. They may include individuals with spinal cord injuries, hemi-plegia and other types of paralysis, multiple sclerosis, cerebral palsy, spina bifida, arthritis, and lower limb amputations. Manual chairs have a number of advantages over power chairs, and most people prefer to use a manual chair if at all possible. In fact, according to the Center for Injury Research and Control, there are over 1.4 million wheelchair users in the United States, and about 75% of them use manual wheelchairs.

As opposed to power models, manuals have unlimited range since they are not dependent on the charge capacity of a battery, they cost less to purchase than power chairs, and they have lower maintenance costs thanks to fewer working parts and their battery-free operation. In addition, manual chairs are more discreet than power chairs since they are less bulky, and with no motor noise, they are much quieter. While it may take more work to operate a manual chair, these lightweight mobiles are getting lighter all the time, and they now require less strength and energy to push than their predecessors. While the low cost and lack of maintenance required for manual wheelchairs encompass a large part of their appeal, many patients would attest to at least one drawback to their use.

Especially for those wheelchair-bound users who enjoy spending time outdoors, having to deal with weather conditions can present challenges. Like anyone else, these consumers have to have an umbrella at the ready in order to protect themselves from sudden rain or the excessive brightness or heat of the sun. However, with the limits to their mobility requiring them to use both hands to operate the wheelchair, holding on to an umbrella while trying to do so is not only impractical, but quite impossible. As a result, many wheelchair users are forced to remain inside even on the clearest of days, unsure if the weather will suddenly change and necessitate the use of an umbrella. Obviously, it would be advantageous to provide a means for protecting wheelchair users during inclement weather conditions while they are outdoors.

U.S. Pat. No. 4,789,200 to Munguia discloses a fisherman's boat chair that is provided with a tubular support for retaining an umbrella positionable over the chair. The height of the umbrella is adjustable by the selective positioning of a pin through one of a plurality of available through-extending apertures in the support, and the shank of the umbrella is supported by the pin. Velcro strips are used to prevent umbrella rotation and withdrawal from the support after it has been placed in position. The modified chair may also include a quickly removable and attachable beverage holder. Unfortunately, this prior art example is not designed to be used by handicapped persons.

U.S. Pat. No. 5,634,650 to Hensler discloses a recreational wheelchair that has four oversized low pressure tires for use on beaches, lakeshores or other soft or rough terrain environments. The structural members of the chair are made of rugged and corrosion resistant materials such as polyvinyl chloride, stainless steel or aluminum, and the chair is designed to be submerged into water of limited depths. The chair includes a high strength box chassis, removable armrest and accessories for recreation such as an umbrella bracket, fishing rod holder, and oxygen tank mounting. Unfortunately, this prior art example is not designed to shade a user from sun or rain.

U.S. Pat. No. 6,471,289 to Aguilar discloses an umbrella attached to a chair for self-supported deployment thereof and includes a cover of fabric stretched over hinged ribs radiating from a central pole for movement from a collapsed position around the pole to an extended position from the pole to provide shade to the chair occupant. One end of the pole is pivotally mounted allowing the pole to pivot from a downwardly depending position to a generally upwardly directed position where the fabric cover may be moved to its extended shade providing position. A latch device is attached to the pole for releasably holding it in an upwardly directed position. Unfortunately, this prior art example is not designed for the unique properties of a manual wheel chair.

Accordingly, the present invention is disclosed in order to overcome the above noted shortcoming. The present invention satisfies such a need by providing an apparatus that is convenient and easy to use, lightweight yet durable in design, and designed for providing a barrier between a user and the sun and rain thereby allowing the user to comfortably employ an existing wheelchair in outdoor environments. The apparatus offers wheelchair users a simple and convenient solution to weather challenges when spending time outdoors. A durable umbrella is made expressly for manual wheelchairs, and provides sufficient protection against the damaging rays of the sun, as well as unexpected downpours of rain, in a hands-free manner. As a result, a user may comfortably operate their chairs without the hassle of trying to manage an umbrella at the same time. In this manner, a user confined to a wheelchair is able to enjoy the refreshing outdoors, without any worry about weather conditions. A handy tote is offered along with the umbrella, and a user can transport virtually any personal item. Universal in concept, a wheel chair umbrella may accommodate manual wheelchairs of virtually any size. Constructed of high quality materials, this product should withstand years of continued use. The present invention is simple to use, inexpensive, and designed for many years of repeated use.

BRIEF SUMMARY OF THE INVENTION

In view of the foregoing background, it is therefore an object of the present invention to provide a means for providing a barrier between a user and the sun and rain thereby allowing the user to comfortably employ an existing wheelchair in outdoor environments. These and other objects, features, and advantages of the invention are provided by a wheelchair umbrella.

The wheelchair umbrella includes an umbrella section. Such an umbrella section includes a circular canopy. Such a canopy effectively has a center region statically attached to the top ends of the arms. Such top ends of the arms are attached to a lower surface of the canopy and extend downwardly and away therefrom. The canopy has an outer perimeter equidistantly spaced from the top ends of the arms, and is formed from a flexible material such that the canopy can be folded about the longitudinal lengths of the arms during storage and transport procedures. The canopy is suitably sized such that it provides a barrier between the sun or rain and the user sitting in the existing wheelchair as well as another person pushing the existing wheelchair during operating conditions.

The apparatus further includes a pair of coextensively shaped rectilinear arms with top ends directly connected to the umbrella section. Such top ends of the arms are hingedly attached to each other wherein each of the arms includes an upper section and a lower section respectively. Such an upper section conveniently has a diameter that is less than a diameter of the lower section such that the upper section telescopically interfits within the lower section along respective longitudinal lengths thereof, and the respective longitudinal lengths are equal.

The apparatus further includes a mechanism for removably attaching bottom ends of the arms to associated ones of the handles of the existing wheelchair. Such a removably attaching mechanism includes a pair of plates directly attached to diametrically opposed outer surfaces of each of the bottom ends of the lower sections of the arms. Each of such plates advantageously has a top surface registered perpendicular to the longitudinal length of an associated one of the arms, and the plates have a bottom edge residing flush with a bottom edge of the bottom end of the associated one of the arms.

The removably attaching mechanism further includes a flexible and planar band with a first end directly attached to an outer edge of each of the plates simultaneously and spanning therebetween. Such a band has a longitudinally opposed second end extending downwardly and away from the first end of the band. The mechanism further includes a flexible and planar tab with a first end monolithically formed with the second end of the band. Such a tab has a longitudinally opposed second end extending outwardly and away from the first end of the tab, and has a lateral width that is less than a lateral width of the band and a thickness that is equal to thickness of the band. The tab further has an inner surface oriented parallel with an inner surface of the band.

The removably attaching mechanism further includes a pair of coextensively shaped knobs monolithically formed in opposed lateral corners of the second end of the tab. Each of such knobs effectively has a diameter that is greater than the respective thicknesses of the tab and the band. The mechanism further includes a ring-shaped fastener directly attached to an inner edge of each of the plates simultaneously and spanning therebetween. Such a fastener has a diameter that is substantially equal to the lateral width of the band, and has an open end oriented opposite the inner surfaces of the plates. Such an open end of the fastener extends outwardly and downwardly from the plates.

The tab is interfitted within the open end of the fastener when the band is wrapped about an associated one of the handles of the existing wheelchair. The knobs prohibits the tab from prematurely and undesirably exiting the open end of the fastener. The band and the tab and the knobs and the fastener respectively cooperate to conveniently securely fasten the bottom ends of the arms to an associated one of the handles of the wheelchair and thereby prohibit the arms from prematurely and undesirably separating from the handles of the existing wheelchair during operating conditions.

The wheelchair umbrella further includes a mechanism for storing and transporting the wheelchair umbrella during non-operating conditions. Such a storage and transport mechanism advantageously includes a flexible bag provided with an opening formed in a top surface thereof. Such a bag has a hollow interior spanning a longitudinal length thereof, and the opening has a fastener adapted along a linear path defined by the longitudinal length of the bag. The longitudinal length of the bag is less than the distance spanning between the handles of the existing wheelchair, and is suitably shaped and sized such that the umbrella section is wholly contained therein during storage and transport procedures. The storage and transport mechanism further includes a plurality of pockets formed in a front surface of the bag, and each of the pockets effectively has a fastener adapted along a linear path registered parallel with respective top edges thereof.

The wheelchair umbrella further includes a mechanism for securing the storage and transport mechanism to the existing wheelchair during operating conditions. Such a securing mechanism conveniently includes a pair of loops statically attached to opposed longitudinal ends of the bag. Each of such loops extends upwardly and above the top surface of the bag, and the loops have a centrally registered axis oriented perpendicular to the longitudinal length of the bag. Each of the loops further is fitted about an associated one of the handles of the existing wheelchair such that the bag is abutted against a rear of the existing wheelchair while it is simultaneously spaced from a ground surface.

The securing mechanism further includes a closed ring directly attached to each of the loops and extending downwardly therefrom. Each of such rings has a centrally registered axis oriented at a right angle to the centrally registered axis of an associated one of the loops. The securing mechanism further includes an elongated strap with axially opposed ends. Each of such opposed ends of the strap advantageously terminate in a clip-hook directly attached thereto, and each of the clip-hooks is removably attached to an associated one of the loops. The strap has a longitudinal length that is greater than the longitudinal length of the bag, and the strap is looped about the handles of the existing wheelchair when the bag is attached to the handles of the existing wheelchair for prohibiting the bag from prematurely and undesirably separating from the handles of the existing wheelchair during operating conditions.

A method for providing a barrier between a user and the sun and rain by employing a wheelchair umbrella and thereby allowing the user to comfortably employ an existing wheelchair in outdoor environments includes the steps of: providing an umbrella section and connecting top ends of a pair of coextensively shaped rectilinear arms directly to the umbrella section. Such top ends of the arms are hingedly attached to each other. The steps further include: attaching bottom ends of the arms to associated ones of the handles of the existing wheelchair; storing and transporting the wheelchair umbrella during non-operating conditions; and securing the storage and transport mechanism to the existing wheelchair during operating conditions.

The method further includes the step of attaching a pair of plates directly to diametrically opposed outer surfaces of each of the bottom ends of the lower sections of the arms. Each of such plates has a top surface registered perpendicular to the longitudinal length of an associated one of the arms, and the plates have a bottom edge residing flush with a bottom edge of the bottom end of the associated one of the arms. The steps further include attaching a first end of a flexible and planar band directly to an outer edge of each of the plates simultaneously and spanning therebetween. Such a band has a longitudinally opposed second end extending downwardly and away from the first end of the band. The steps further include providing a flexible and planar tab with a first end monolithically formed with the second end of the band. Such a tab has a longitudinally opposed second end extending outwardly and away from the first end of the tab, and further has a lateral width that is less than a lateral width of the band and a thickness that is equal to thickness of the band. The tab also has an inner surface oriented parallel with an inner surface of the band.

The steps further include providing a pair of coextensively shaped knobs monolithically formed in opposed lateral corners of the second end of the tab. Each of such knobs has a diameter that is greater than the respective thicknesses of the tab and the band. The steps further include attaching a ring-shaped fastener directly to an inner edge of each of the plates simultaneously and spanning therebetween. Such a fastener has a diameter that is substantially equal to the lateral width of the band, and has an open end oriented opposite the inner surfaces of the plates. Such an open end of the fastener extends outwardly and downwardly from the plates and is interfitted within the open end of the fastener when the band is wrapped about an associated one of the handles of the existing wheelchair. The knobs prohibit the tab from prematurely and undesirably exiting the open end of the fastener, and the band and the tab and the knobs and the fastener respectively cooperate to securely fasten the bottom ends of the arms to an associated one of the handles of the wheelchair and thereby prohibit the arms from prematurely and undesirably separating from the handles of the existing wheelchair during operating conditions.

The method further includes the step of providing a flexible bag with an opening formed in a top surface thereof. Such a bag has a hollow interior spanning a longitudinal length thereof, and the opening has a fastener adapted along a linear path defined by the longitudinal length of the bag. The longitudinal length of the bag is less than the distance spanning between the handles of the existing wheelchair, and the bag is suitably shaped and sized such that the umbrella section is wholly contained therein during storage and transport procedures. The steps further include providing a plurality of pockets formed in a front surface of the bag, and each of the pockets has a fastener adapted along a linear path registered parallel with respective top edges thereof.

The method further includes the step of attaching a pair of loops to opposed longitudinal ends of the bag. Each of such loops extends upwardly and above the top surface of the bag, and the loops have a centrally registered axis oriented perpendicular to the longitudinal length of the bag. The steps further include fitting each of the loops about an associated one of the handles of the existing wheelchair such that the bag is abutted against a rear of the existing wheelchair while it is simultaneously spaced from a ground surface.

The steps further include providing a closed ring directly attached to each of the loops and extending downwardly therefrom. Each of such rings has a centrally registered axis oriented at a right angle to the centrally registered axis of an associated one of the loops. The steps further include looping an elongated strap about the handles of the existing wheelchair when the bag is attached to the handles of the existing wheelchair for prohibiting the bag from prematurely and undesirably separating from the handles of the existing wheelchair during operating conditions. Such a strap has axially opposed ends, and each of such opposed ends of the strap terminate in a clip-hook directly attached thereto. The strap has a longitudinal length that is greater than the longitudinal length of the bag. The final step includes attaching each of the clip-hooks to an associated one of the loops.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
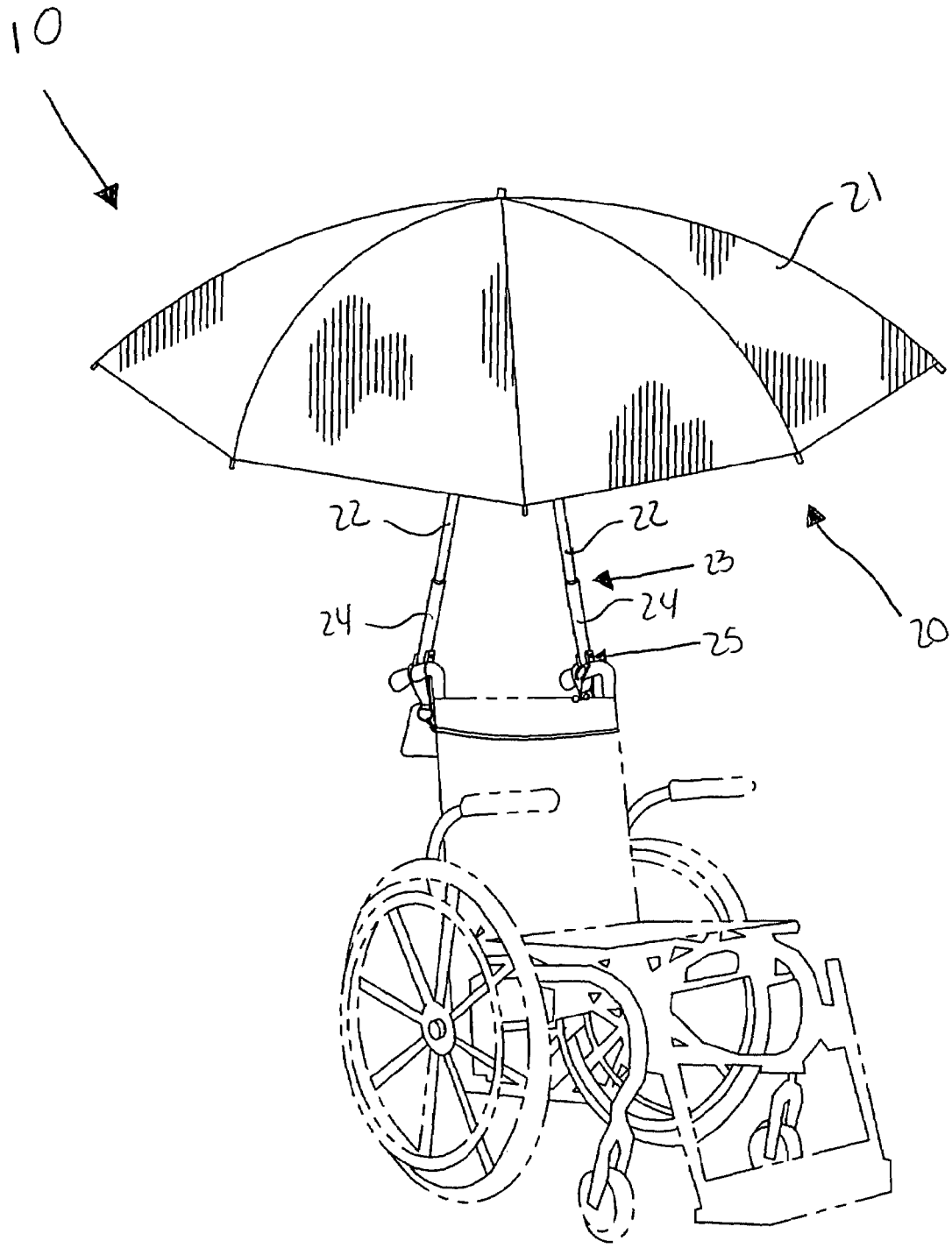
FIG. 1 is a perspective view showing a wheelchair umbrella attached to a wheelchair, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-9 by the reference numeral 10 and is intended to provide a means for providing a barrier between a user and the sun and rain thereby allowing the user to comfortably employ an existing wheelchair in outdoor environments. It should be understood that the apparatus 10 may be used to shield against many different types of weather, and should not be limited in use with only that kind of weather mentioned herein.

Figure 5:
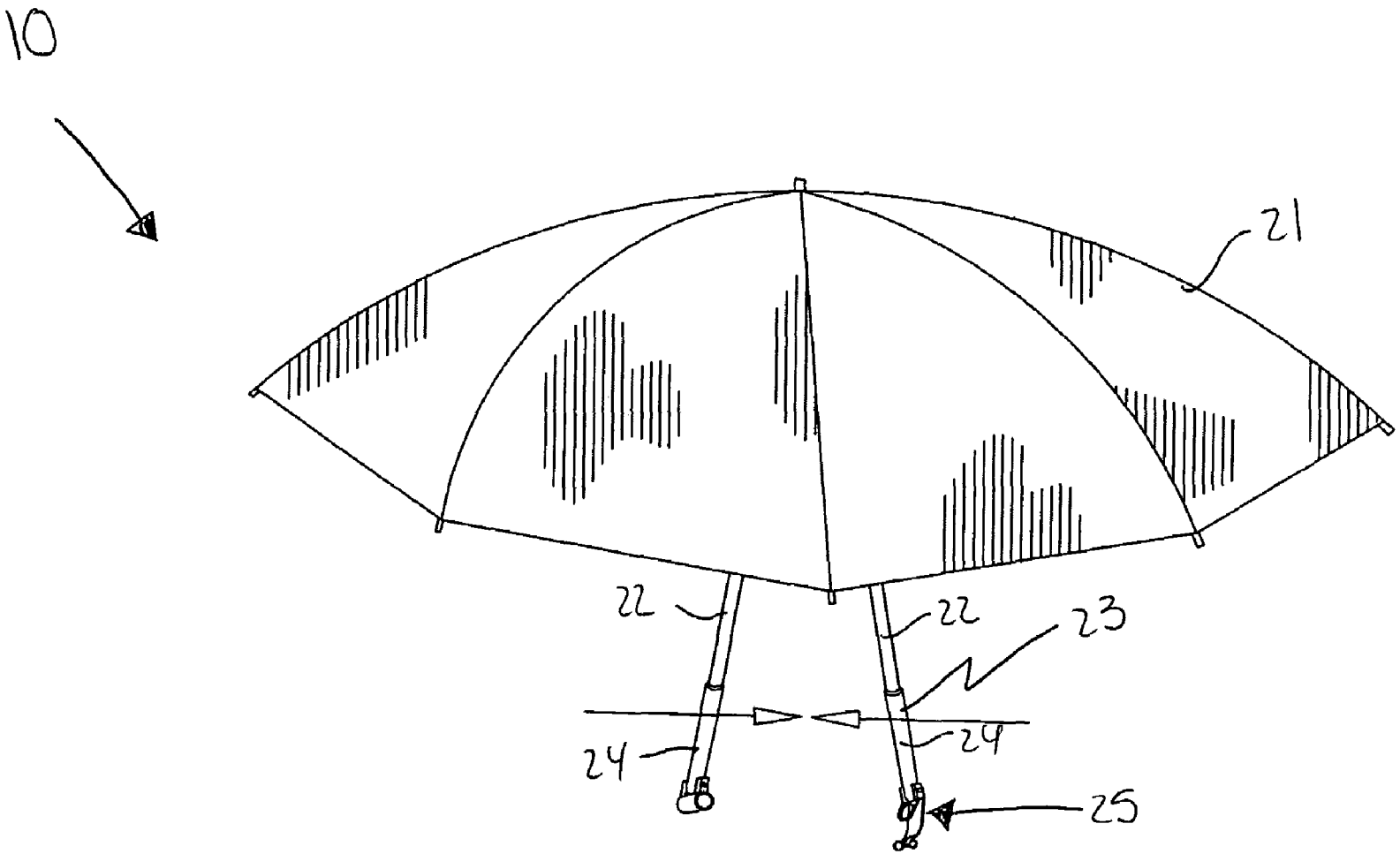
FIG. 5 is a perspective view of a wheelchair umbrella in an open position, in accordance with the present invention.
Figure 6:
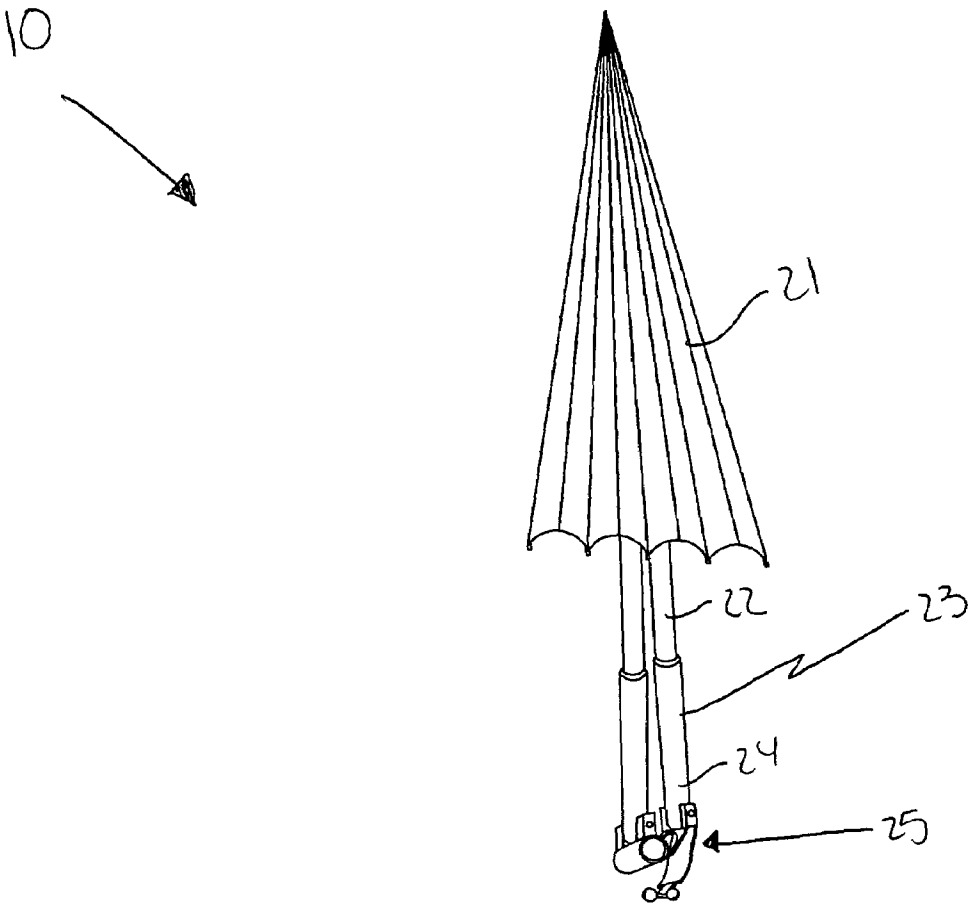
FIG. 6 is a perspective view of a wheelchair umbrella in a closed position, in accordance with the present invention.

Referring to FIGS. 1, 5 and 6, the wheelchair umbrella includes an umbrella section 20. Such an umbrella section 20 includes a circular canopy 21. Such a canopy 21 has a center region statically attached to the top ends of the arms 23. Such top ends of the arms 23 are attached to a lower surface of the canopy 21 and extend downwardly and away therefrom. The canopy 21 has an outer perimeter equidistantly spaced from the top ends of the arms 23, and is formed from a flexible material which is essential such that the canopy 21 can be folded about the longitudinal lengths of the arms 23 during storage and transport procedures. The canopy 21 is suitably sized which is important such that it provides a barrier between the sun or rain and the user sitting in the existing wheelchair as well as another person pushing the existing wheelchair during operating conditions. The canopy provides a means for shielding a user against rain or sun when a user is outdoors.

Referring again to FIGS. 1, 5 and 6, the apparatus further includes a pair of coextensively shaped rectilinear arms 23 with top ends directly connected, without the use of intervening characters, to the umbrella section 20. Such top ends of the arms 23 are hingedly attached to each other wherein each of the arms 23 includes an upper section 22 and a lower section 24 respectively. Such an upper section 22 has a diameter that is less than a diameter of the lower section 24 which is crucial such that the upper section 22 telescopically interfits within the lower section 24 along respective longitudinal lengths thereof, and the respective longitudinal lengths are equal. The arms provide a means for suspending the canopy over a user head during operation.

Figure 2:
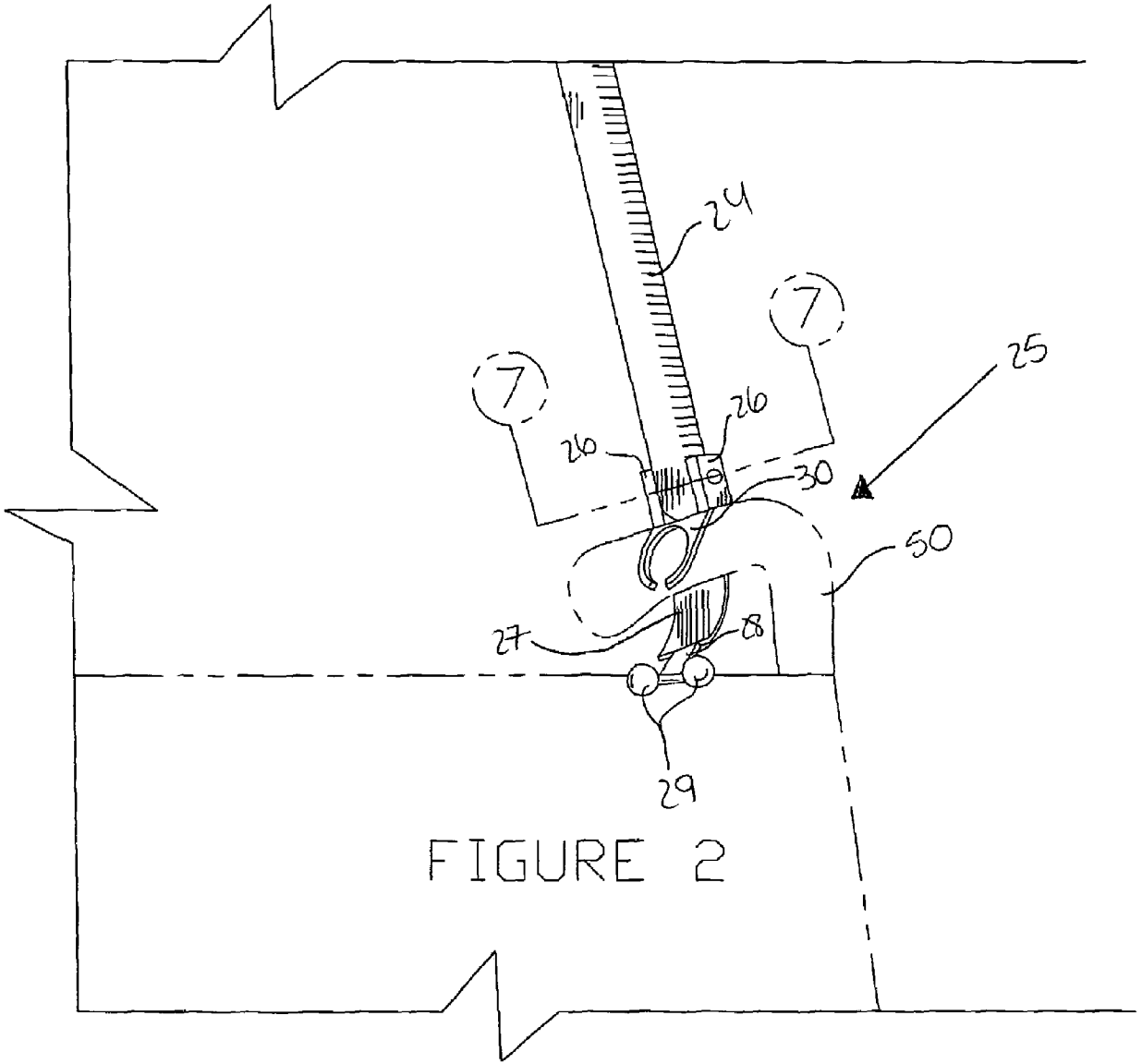
FIG. 2 is an enlarged perspective view of the removably attaching mechanism in an open position, in accordance with the present invention.
Figure 3:
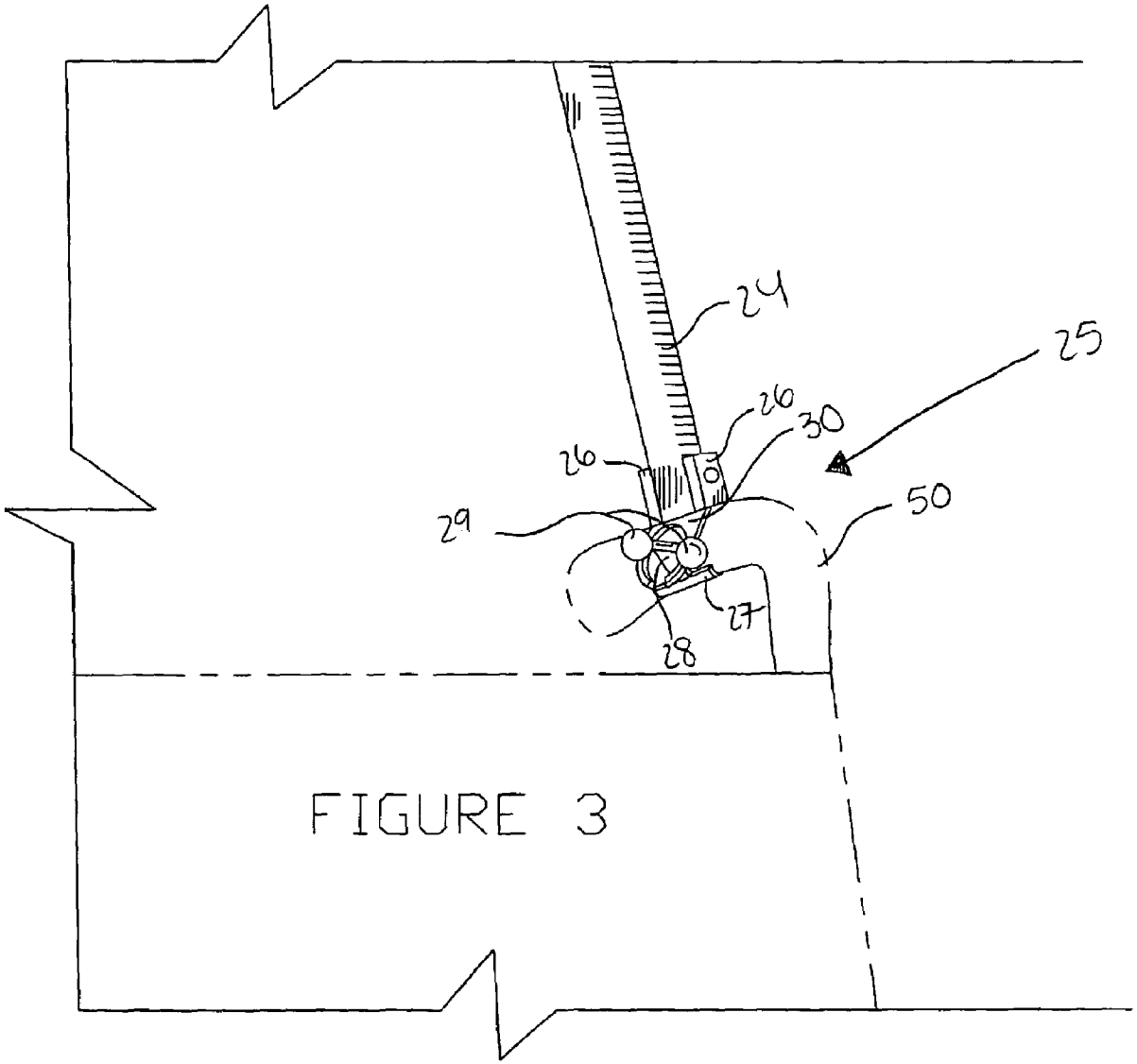
FIG. 3 is an enlarged perspective view of the removably attaching mechanism in a closed and secured position, in accordance with the present invention.
Figure 4:
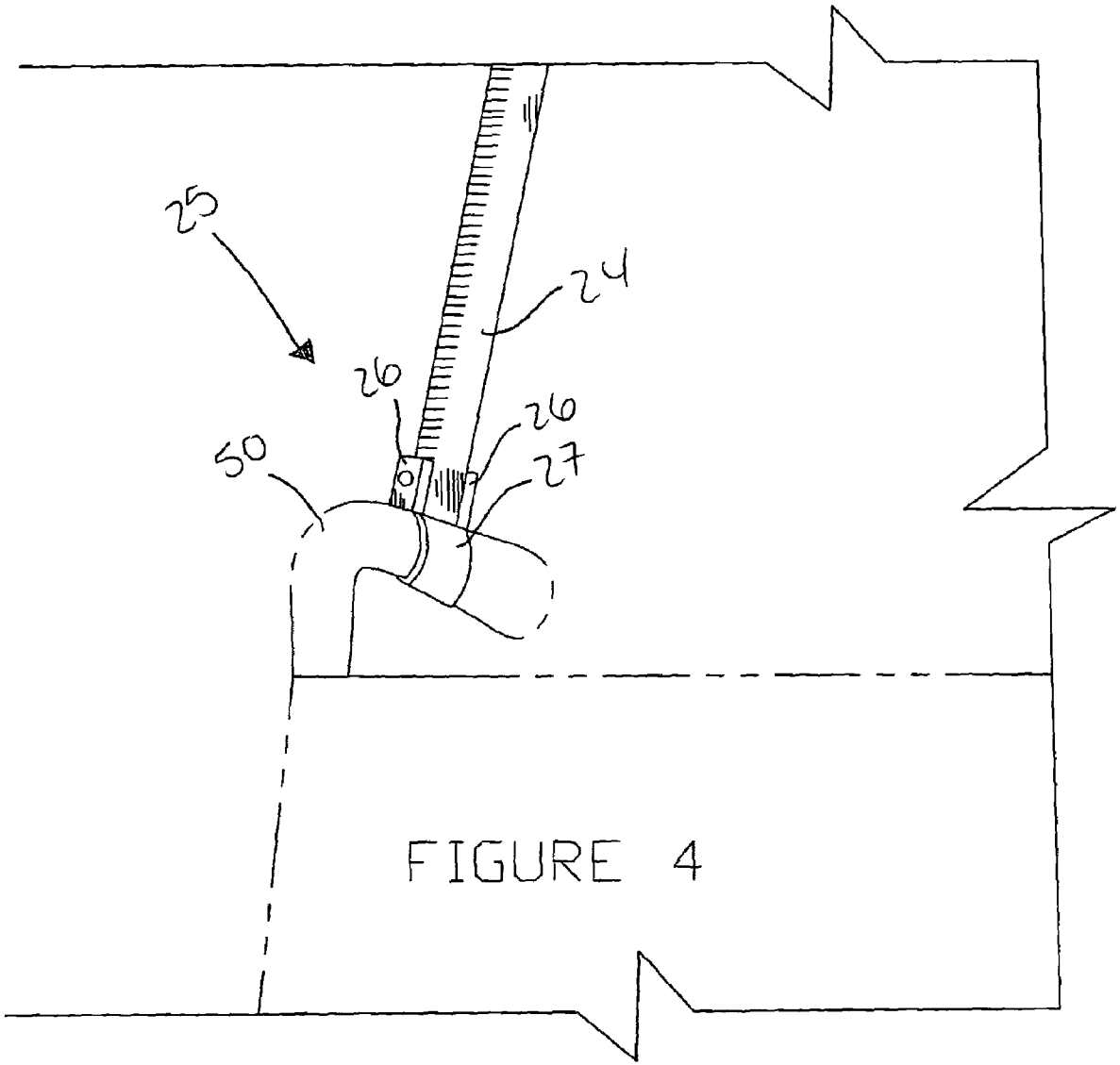
FIG. 4 is an enlarged view of the removable attaching mechanism showing an alternate side of the mechanism, in accordance with the present invention.

Referring to FIGS. 2, 3, and 4, the apparatus further includes a mechanism for removably attaching bottom ends of the arms 23 to associated ones of the handles of the existing wheelchair. Such a removably attaching mechanism 25 includes a pair of plates 26 directly attached, without the use of intervening characters, to diametrically opposed outer surfaces of each of the bottom ends of the lower sections 24 of the arms. Each of such plates 26 has a top surface registered perpendicular to the longitudinal length of an associated one of the arms, and the plates 26 have a bottom edge residing flush with a bottom edge of the bottom end of the associated one of the arms 23. The removably attaching mechanism provides a means for allowing a user to attach the arms and canopy as needed for shielding purposes.

The removably attaching mechanism further includes a flexible and planar band 27 with a first end directly attached, without the use of intervening characters, to an outer edge of each of the plates 26 simultaneously and spanning therebetween. Such a band 27 has a longitudinally opposed second end extending downwardly and away from the first end of the band. The mechanism further includes a flexible and planar tab 28 with a first end monolithically formed with the second end of the band 27. Such a tab 28 has a longitudinally opposed second end extending outwardly and away from the first end of the tab, and has a lateral width that is less than a lateral width of the band 27 and a thickness that is equal to thickness of the band. The tab 28 further has an inner surface oriented parallel with an inner surface of the band.

The removably attaching mechanism 25 further includes a pair of coextensively shaped knobs 29 monolithically formed in opposed lateral corners of the second end of the tab 28. Each of such knobs 29 has a diameter that is greater than the respective thicknesses of the tab 28 and the band 27. The mechanism further includes a ring-shaped fastener 30 directly attached, without the use of intervening characters, to an inner edge of each of the plates 26 simultaneously and spanning therebetween. Such a fastener 30 has a diameter that is substantially equal to the lateral width of the band 27, and has an open end oriented opposite the inner surfaces of the plates. Such an open end of the fastener 30 extends outwardly and downwardly from the plates 26. The ring shaped fastener ensures that the attaching mechanism remains intact and the canopy remains upright as long as needed by a user, and may also include buttons, snap-closures, or tie-downs, as examples.

The tab 28 is interfitted within the open end of the fastener 30 when the band 27 is wrapped about an associated one of the handles 50 of the existing wheelchair. The knobs 29 prohibit the tab 28 from prematurely and undesirably exiting the open end of the fastener 30. The band 27 and the tab 28 and the knobs 29 and the fastener 30 respectively cooperate to securely fasten the bottom ends of the arms to an associated one of the handles 50 of the wheelchair and thereby prohibit the arms from prematurely and undesirably separating from the handles of the existing wheelchair during operating conditions.

Figure 7:
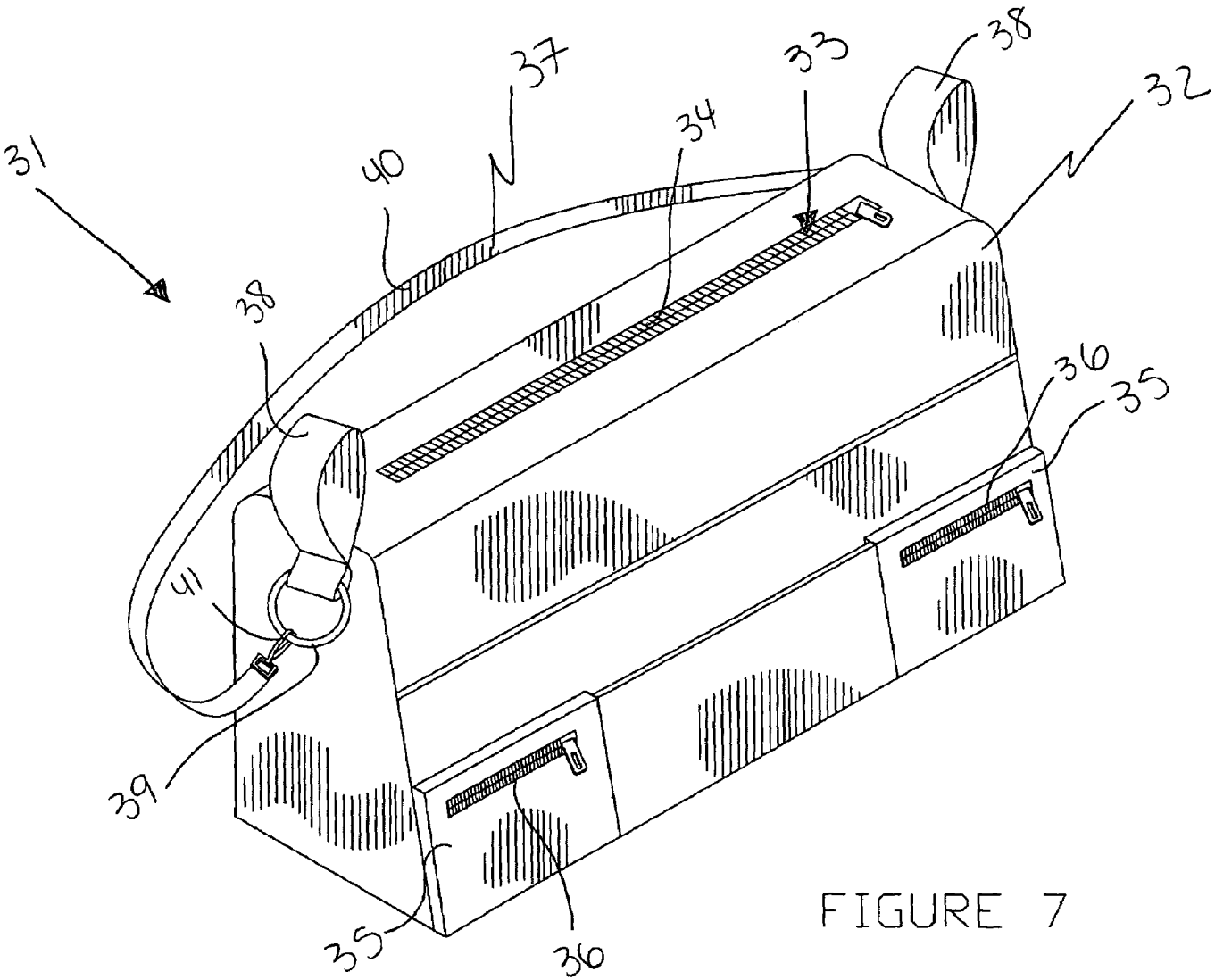
FIG. 7 is a perspective view of a storage and transport mechanism, in accordance with the present invention.
Figure 8:
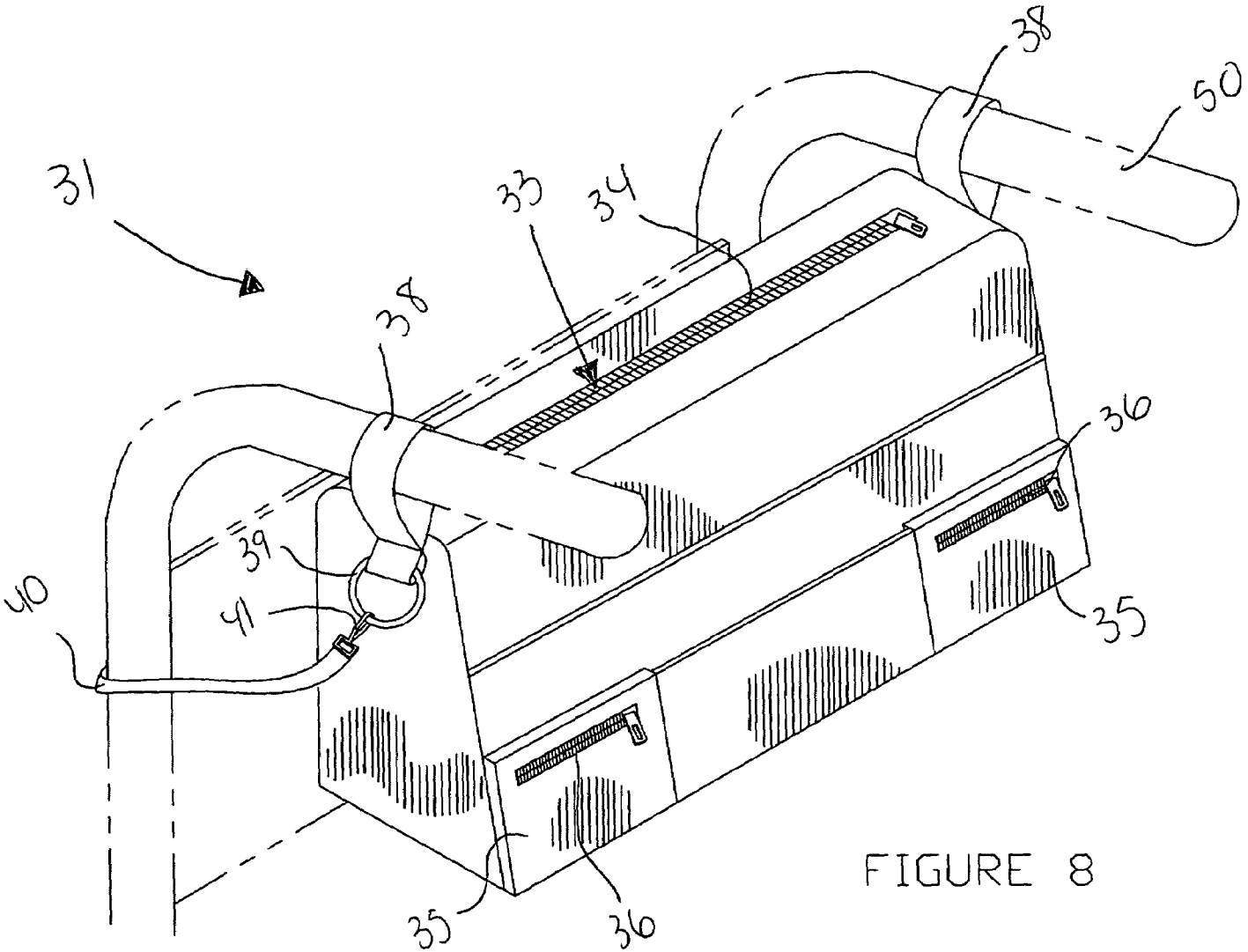
FIG. 8 is a perspective view of a storage and transport mechanism attached to a wheelchair, in accordance with the present invention.
Figure 9:
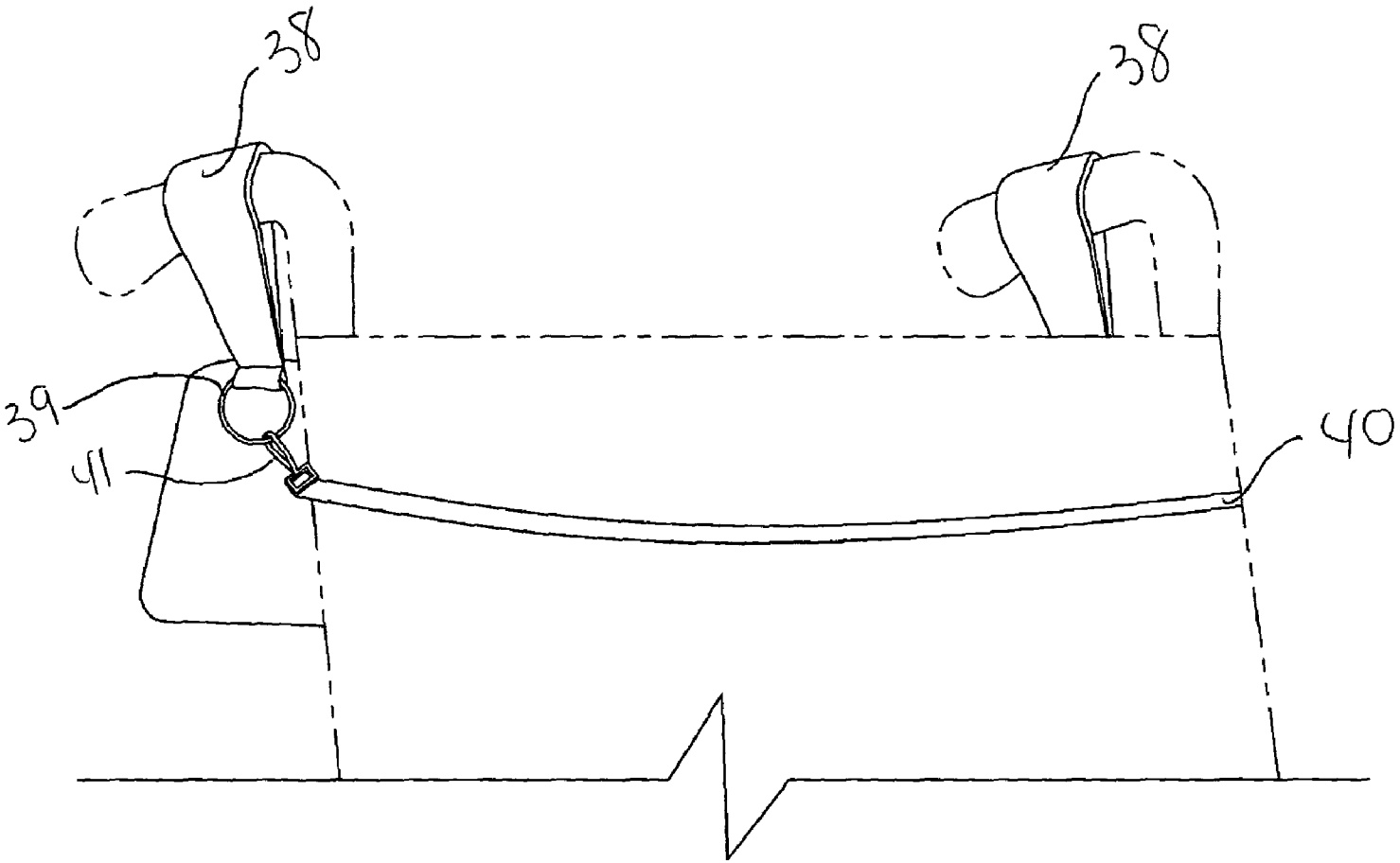
FIG. 9 is a perspective view showing a securing mechanism, in accordance with the present invention.

Referring to FIGS. 7 and 8, the wheelchair umbrella further includes a mechanism for storing and transporting the wheelchair umbrella during non-operating conditions. Such a storage and transport mechanism 31 includes a flexible bag 32 provided with an opening 33 formed in a top surface thereof. Such a bag 32 has a hollow interior spanning a longitudinal length thereof, and the opening 33 has a fastener 34 adapted along a linear path defined by the longitudinal length of the bag 32. The longitudinal length of the bag 32 is less than the distance spanning between the handles of the existing wheelchair, and is suitably shaped and sized which is vital such that the umbrella section 20 is wholly contained therein during storage and transport procedures. The storage and transport mechanism 31 further includes a plurality of pockets 35 formed in a front surface of the bag 32, and each of the pockets 35 has a fastener 36 adapted along a linear path registered parallel with respective top edges thereof. The storage and transport mechanism allows a user to store the umbrella when it is not needed, but to keep the umbrella in an easily accessible place in case it Referring to FIGS. 7, 8, and 9, the wheelchair umbrella further includes a mechanism for securing the storage and transport mechanism to the existing wheelchair during operating conditions. Such a securing mechanism 37 includes a pair of loops 38 statically attached to opposed longitudinal ends of the bag 32. Each of such loops 38 extends upwardly and above the top surface of the bag 32, and the loops 38 have a centrally registered axis oriented perpendicular to the longitudinal length of the bag 32. Each of the loops 38 further is fitted about an associated one of the handles 50 of the existing wheelchair such that the bag 32 is abutted against a rear of the existing wheelchair while it is simultaneously spaced from a ground surface. The securing mechanism ensures that the storing and transport mechanism stays intact when the wheelchair is in motion.

The securing mechanism further includes a closed ring 39 directly attached, without the use of intervening characters, to each of the loops 38 and extending downwardly therefrom. Each of such rings 39 has a centrally registered axis oriented at a right angle to the centrally registered axis of an associated one of the loops 38. The securing mechanism further includes an elongated strap 40 with axially opposed ends. Each of such opposed ends of the strap terminate in a clip-hook 41 directly attached thereto, and each of the clip-hooks 41 is removably attached to an associated one of the loops 38. The strap 40 has a longitudinal length that is greater than the longitudinal length of the bag 32, and the strap 40 is looped about the handles 50 of the existing wheelchair when the bag 32 is attached to the handles 50 of the existing wheelchair for prohibiting the bag 32 from prematurely and undesirably separating from the handles 50 of the existing wheelchair during operating conditions. The strap also allows the user to easily transport the bag during transport procedures.

In use, a wheelchair umbrella is simple and straightforward to operate. First, both the umbrella and bag are installed to an existing manual wheelchair. The storage and transport mechanism is then filled with any items needed by a user. Even without the assistance, a user needs only to fold or unfold the canopy. When no longer needed, the canopy may be retracted and securely closed until needed again.

The storage and transport mechanism provides the unexpected benefit of allowing a user to store the wheelchair umbrella when the apparatus is not needed. However, this mechanism also keeps the umbrella close at hand for when needed by a user. In addition, the removably attaching mechanism allows a user to easily attach the umbrella to a wheel chair for hands-free shelter from inclement weather. Such benefits overcome the prior art shortcomings.

In use, a method for providing a barrier between a user and the sun and rain by employing a wheelchair umbrella and thereby allowing the user to comfortably employ an existing wheelchair in outdoor environments includes the steps of: providing an umbrella section 20 and connecting top ends of a pair of coextensively shaped rectilinear arms 23 directly to the umbrella section. Such top ends of the arms 23 are hingedly attached to each other. The steps further include: attaching bottom ends of the arms 23 to associated ones of the handles 50 of the existing wheelchair; storing and transporting the wheelchair umbrella during non-operating conditions; and securing the storage and transport mechanism to the existing wheelchair during operating conditions.

In use, the method further includes the step of attaching a pair of plates 26 directly to diametrically opposed outer surfaces of each of the bottom ends of the lower sections 24 of the arms 23. Each of such plates 26 has a top surface registered perpendicular to the longitudinal length of an associated one of the arms, and the plates 26 have a bottom edge residing flush with a bottom edge of the bottom end of the associated one of the arms. The steps further include attaching a first end of a flexible and planar band 27 directly to an outer edge of each of the plates 26 simultaneously and spanning therebetween. Such a band 27 has a longitudinally opposed second end extending downwardly and away from the first end of the band 27. The steps further include providing a flexible and planar tab 28 with a first end monolithically formed with the second end of the band 27. Such a tab 28 has a longitudinally opposed second end extending outwardly and away from the first end of the tab 28, and further has a lateral width that is less than a lateral width of the band 27 and a thickness that is equal to thickness of the band 27. The tab 28 also has an inner surface oriented parallel with an inner surface of the band.

In use, the steps further include providing a pair of coextensively shaped knobs 29 monolithically formed in opposed lateral corners of the second end of the tab 28. Each of such knobs 29 has a diameter that is greater than the respective thicknesses of the tab 28 and the band 27. The steps further include attaching a ring-shaped fastener 30 directly to an inner edge of each of the plates 26 simultaneously and spanning therebetween. Such a fastener 30 has a diameter that is substantially equal to the lateral width of the band 27, and has an open end oriented opposite the inner surfaces of the plates 26. Such an open end of the fastener 30 extends outwardly and downwardly from the plates 26 and is interfitted within the open end of the fastener 30 when the band 27 is wrapped about an associated one of the handles 50 of the existing wheelchair. The knobs 29 prohibit the tab 28 from prematurely and undesirably exiting the open end of the fastener 30, and the band 27 and the tab 28 and the knobs 29 and the fastener 30 respectively cooperate to securely fasten the bottom ends of the arms to an associated one of the handles 50 of the wheelchair and thereby prohibit the arms from prematurely and undesirably separating from the handles of the existing wheelchair during operating conditions.

In use, the method further includes the step of providing a flexible bag 32 with an opening 33 formed in a top surface thereof. Such a bag 32 has a hollow interior spanning a longitudinal length thereof, and the opening 33 has a fastener 34 adapted along a linear path defined by the longitudinal length of the bag 32. The longitudinal length of the bag 32 is less than the distance spanning between the handles 50 of the existing wheelchair, and the bag 32 is suitably shaped and sized such that the umbrella section 20 is wholly contained therein during storage and transport procedures. The steps further include providing a plurality of pockets 35 formed in a front surface of the bag 32, and each of the pockets 35 has a fastener 34 adapted along a linear path registered parallel with respective top edges thereof.

In use, the method further includes the step of attaching a pair of loops 38 to opposed longitudinal ends of the bag 32. Each of such loops 38 extends upwardly and above the top surface of the bag 32, and the loops 38 have a centrally registered axis oriented perpendicular to the longitudinal length of the bag. The steps further include fitting each of the loops 38 about an associated one of the handles 50 of the existing wheelchair such that the bag 32 is abutted against a rear of the existing wheelchair while it is simultaneously spaced from a ground surface.

In use, the steps further include providing a closed ring 39 directly attached to each of the loops 38 and extending downwardly therefrom. Each of such rings 39 has a centrally registered axis oriented at a right angle to the centrally registered axis of an associated one of the loops 38. The steps further include looping an elongated strap 40 about the handles 50 of the existing wheelchair when the bag 32 is attached to the handles 50 of the existing wheelchair for prohibiting the bag 32 from prematurely and undesirably separating from the handles 50 of the existing wheelchair during operating conditions. Such a strap 40 has axially opposed ends, and each of such opposed ends of the strap 40 terminate in a clip-hook directly attached thereto. The strap 40 has a longitudinal length that is greater than the longitudinal length of the bag 32. The final step includes attaching each of the clip-hooks 41 to an associated one of the loops.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A wheelchair umbrella for providing a barrier between a user and the sun and rain thereby allowing the user to comfortably employ an existing wheelchair in outdoor environments, said wheelchair umbrella comprising:

an umbrella section;

a pair of coextensively shaped rectilinear arms having top ends directly connected to said umbrella section;

means for removably attaching bottom ends of said arms to associated ones of the handles of the existing wheelchair;

means for storing and transporting said wheelchair umbrella during non-operating conditions; and means for securing said storage and transport means to the existing wheelchair during operating conditions;

wherein said umbrella section comprises:

a circular canopy, said canopy having a center region statically attached to said top ends of said arms, said top ends of said arms being attached to a lower surface of said canopy and extending downwardly and away therefrom, said canopy having an outer perimeter equidistantly spaced from said top ends of said arms, said canopy being formed from a flexible material such that said canopy can be folded about the longitudinal lengths of the arms during storage and transport procedures;

wherein said canopy is suitably sized such that said canopy provides a barrier between the sun or rain and the user sitting in the existing wheelchair as well as another person pushing the existing wheelchair during operating conditions;

wherein each of said arms comprises:

an upper section and a lower section respectively, said upper section having a diameter that is less than a diameter of said lower section such that said upper section telescopically interfits within said lower section along respective longitudinal lengths thereof, said respective longitudinal lengths being equal;

wherein said removably attaching means comprises:

a pair of plates directly attached to diametrically opposed outer surfaces of each of said bottom ends of said lower sections of said arms, each of said plates having a top surface registered perpendicular to said longitudinal length of an associated one of said arms, said plates having a bottom edge residing flush with a bottom edge of said bottom end of said associated one of said arms;

a flexible and planar band having a first end directly attached to an outer edge of each of said plates simultaneously and spanning therebetween, said band having a longitudinally opposed second end extending downwardly and away from said first end of said band;

a flexible and planar tab having a first end monolithically formed with said second end of said band, said tab having a longitudinally opposed second end extending outwardly and away from said first end of said tab, said tab having a lateral width that is less than a lateral width of said band and a thickness that is equal to thickness of said band, said tab having an inner surface oriented parallel with an inner surface of said band;

a pair of coextensively shaped knobs monolithically formed in opposed lateral corners of said second end of said tab, each of said knobs having a diameter that is greater than said respective thicknesses of said tab and said band; and a ring-shaped fastener directly attached to an inner edge of each of said plates simultaneously and spanning therebetween, said fastener having a diameter that is substantially equal to said lateral width of said band, said fastener having an open end oriented opposite said inner surfaces of said plates, said open end of said fastener extending outwardly and downwardly from said plates;

wherein said tab is interfitted within said open end of said fastener when said band is wrapped about an associated one of the handles of the existing wheelchair, said knobs prohibiting said tab from prematurely and undesirably exiting said open end of said fastener;

wherein said band and said tab and said knobs and said fastener respectively cooperate to securely fasten said bottom ends of said arms to an associated one of the handles of the wheelchair and thereby prohibit said arms from prematurely and undesirably separating from the handles of the existing wheelchair during operating conditions.

2. The wheelchair umbrella of claim 1, wherein said storage and transport means comprises:

a flexible bag provided with an opening formed in a top surface thereof, said bag having a hollow interior spanning a longitudinal length thereof, said opening having a fastener adapted along a linear path defined by said longitudinal length of said bag, said longitudinal length of said bag being less than the distance spanning between the handles of the existing wheelchair, said bag being suitably shaped and sized such that said umbrella section is wholly contained therein during storage and transport procedures; and a plurality of pockets formed in a front surface of said bag, each of said pockets having a fastener adapted along a linear path registered parallel with respective top edges thereof.

3. The wheelchair umbrella of claim 2, wherein said securing means comprises:

a pair of loops statically attached to opposed longitudinal ends of said bag, each of said loops extending upwardly and above said top surface of said bag, said loops having a centrally registered axis oriented perpendicular to said longitudinal length of said bag, each of said loops being fitted about an associated one of said handles of the existing wheelchair such that said bag is abutted against a rear of the existing wheelchair while being simultaneously spaced from a ground surface;

a closed ring directly attached to each of said loops and extending downwardly therefrom, each of said rings having a centrally registered axis oriented at a right angle to said centrally registered axis of an associated one of said loops; and an elongated strap having axially opposed ends, each of said opposed ends of said strap terminating in a clip-hook directly attached thereto, each of said clip-hooks being removably attached to an associated one of said loops, said strap having a longitudinal length that is greater than said longitudinal length of said bag;

wherein said strap is looped about the handles of the existing wheelchair when said bag is attached to the handles of the existing wheelchair for prohibiting said bag from prematurely and undesirably separating from the handles of the existing wheelchair during operating conditions.

4. A wheelchair umbrella for providing a barrier between a user and the sun and rain thereby allowing the user to comfortably employ an existing wheelchair in outdoor environments, said wheelchair umbrella comprising:

an umbrella section;

a pair of coextensively shaped rectilinear arms having top ends directly connected to said umbrella section, said top ends of said arms being hingedly attached to each other;

means for removably attaching bottom ends of said arms to associated ones of the handles of the existing wheelchair;

means for storing and transporting said wheelchair umbrella during non-operating conditions; and means for securing said storage and transport means to the existing wheelchair during operating conditions;

wherein said umbrella section comprises:

a circular canopy, said canopy having a center region statically attached to said top ends of said arms, said top ends of said arms being attached to a lower surface of said canopy and extending downwardly and away therefrom, said canopy having an outer perimeter equidistantly spaced from said top ends of said arms, said canopy being formed from a flexible material such that said canopy can be folded about the longitudinal lengths of the arms during storage and transport procedures;

wherein said canopy is suitably sized such that said canopy provides a barrier between the sun or rain and the user sitting in the existing wheelchair as well as another person pushing the existing wheelchair during operating conditions;

wherein each of said arms comprises:

an upper section and a lower section respectively, said upper section having a diameter that is less than a diameter of said lower section such that said upper section telescopically interfits within said lower section along respective longitudinal lengths thereof, said respective longitudinal lengths being equal;

wherein said removably attaching means comprises:

a pair of plates directly attached to diametrically opposed outer surfaces of each of said bottom ends of said lower sections of said arms, each of said plates having a top surface registered perpendicular to said longitudinal length of an associated one of said arms, said plates having a bottom edge residing flush with a bottom edge of said bottom end of said associated one of said arms;

a flexible and planar band having a first end directly attached to an outer edge of each of said plates simultaneously and spanning therebetween, said band having a longitudinally opposed second end extending downwardly and away from said first end of said band;

a flexible and planar tab having a first end monolithically formed with said second end of said band, said tab having a longitudinally opposed second end extending outwardly and away from said first end of said tab, said tab having a lateral width that is less than a lateral width of said band and a thickness that is equal to thickness of said band, said tab having an inner surface oriented parallel with an inner surface of said band;

a pair of coextensively shaped knobs monolithically formed in opposed lateral corners of said second end of said tab, each of said knobs having a diameter that is greater than said respective thicknesses of said tab and said band; and a ring-shaped fastener directly attached to an inner edge of each of said plates simultaneously and spanning therebetween, said fastener having a diameter that is substantially equal to said lateral width of said band, said fastener having an open end oriented opposite said inner surfaces of said plates, said open end of said fastener extending outwardly and downwardly from said plates;

wherein said tab is interfitted within said open end of said fastener when said band is wrapped about an associated one of the handles of the existing wheelchair, said knobs prohibiting said tab from prematurely and undesirably exiting said open end of said fastener;

wherein said band and said tab and said knobs and said fastener respectively cooperate to securely fasten said bottom ends of said arms to an associated one of the handles of the wheelchair and thereby prohibit said arms from prematurely and undesirably separating from the handles of the existing wheelchair during operating conditions.

5. The wheelchair umbrella of claim 4, wherein said storage and transport means comprises:

a flexible bag provided with an opening formed in a top surface thereof, said bag having a hollow interior spanning a longitudinal length thereof, said opening having a fastener adapted along a linear path defined by said longitudinal length of said bag, said longitudinal length of said bag being less than the distance spanning between the handles of the existing wheelchair, said bag being suitably shaped and sized such that said umbrella section is wholly contained therein during storage and transport procedures; and a plurality of pockets formed in a front surface of said bag, each of said pockets having a fastener adapted along a linear path registered parallel with respective top edges thereof.

6. The wheelchair umbrella of claim 5, wherein said securing means comprises:

a pair of loops statically attached to opposed longitudinal ends of said bag, each of said loops extending upwardly and above said top surface of said bag, said loops having a centrally registered axis oriented perpendicular to said longitudinal length of said bag, each of said loops being fitted about an associated one of said handles of the existing wheelchair such that said bag is abutted against a rear of the existing wheelchair while being simultaneously spaced from a ground surface;

a closed ring directly attached to each of said loops and extending downwardly therefrom, each of said rings having a centrally registered axis oriented at a right angle to said centrally registered axis of an associated one of said loops; and an elongated strap having axially opposed ends, each of said opposed ends of said strap terminating in a clip-hook directly attached thereto, each of said clip-hooks being removably attached to an associated one of said loops, said strap having a longitudinal length that is greater than said longitudinal length of said bag;

wherein said strap is looped about the handles of the existing wheelchair when said bag is attached to the handles of the existing wheelchair for prohibiting said bag from prematurely and undesirably separating from the handles of the existing wheelchair during operating conditions.

* * * * *